US010605143B2

(12) United States Patent
Zhang et al.

(10) Patent No.: US 10,605,143 B2
(45) Date of Patent: Mar. 31, 2020

(54) EXHAUST GAS MIXER

(71) Applicant: Ford Global Technologies, LLC, Dearborn, MI (US)

(72) Inventors: Xiaogang Zhang, Novi, MI (US); Jianwen James Yi, West Bloomfield, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 104 days.

(21) Appl. No.: 15/650,593

(22) Filed: Jul. 14, 2017

(65) Prior Publication Data

US 2019/0017426 A1 Jan. 17, 2019

(51) Int. Cl.

| | |
|---|---|
| ***F01N 3/28*** | (2006.01) |
| ***F02M 26/19*** | (2016.01) |
| ***B01F 5/06*** | (2006.01) |
| ***F02M 26/00*** | (2016.01) |
| ***B01F 3/02*** | (2006.01) |
| ***B01F 5/00*** | (2006.01) |

(52) U.S. Cl.

CPC ..... *F01N 3/2892* (2013.01); *B01F 3/02* (2013.01); *B01F 5/0688* (2013.01); *B01F 5/0689* (2013.01); *F02M 26/00* (2016.02); *F02M 26/19* (2016.02); *B01F 2005/0034* (2013.01); *F01N 2240/20* (2013.01); *F01N 2470/02* (2013.01); *F01N 2470/16* (2013.01); *F01N 2490/08* (2013.01)

(58) Field of Classification Search

CPC combination set(s) only.

See application file for complete search history.

(56) References Cited

U.S. PATENT DOCUMENTS

| | | | | |
|---|---|---|---|---|
| 1,270,015 | A | 6/1918 | Couch | |
| 7,000,449 | B2 | 2/2006 | Silvis et al. | |
| 7,677,788 | B2 | 3/2010 | Weiss et al. | |
| 8,141,353 | B2 | 3/2012 | Zheng et al. | |
| 8,272,777 | B2 | 9/2012 | Kohrs et al. | |
| 8,371,114 | B2 * | 2/2013 | Hayashi | B01D 53/90 60/286 |
| 9,440,204 | B2 * | 9/2016 | Palmer | B01F 5/0473 |
| 9,617,895 | B2 * | 4/2017 | Mueller-Haas | F01N 3/2066 |
| 10,047,657 | B2 * | 8/2018 | Noren, IV | F01N 3/2892 |
| 10,287,948 | B1 * | 5/2019 | Moulieres | F01N 3/208 |
| 2001/0014301 | A1 | 8/2001 | Nakamura et al. | |
| 2009/0031714 | A1 | 2/2009 | Jochumsen et al. | |
| 2010/0005790 | A1 * | 1/2010 | Zhang | F01N 3/36 60/301 |
| 2012/0255287 | A1 * | 10/2012 | Kowada | B01D 53/9431 60/295 |
| 2015/0027556 | A1 | 1/2015 | Huang et al. | |
| 2015/0040537 | A1 | 2/2015 | Hicks et al. | |
| 2015/0047330 | A1 | 2/2015 | Zhang | |

(Continued)

OTHER PUBLICATIONS

Zhang, X., "Systems and Methods for an Exhaust Gas Recirculation Mixer," U.S. Appl. No. 15/250,108, filed Aug. 29, 2016, 34 pages.

*Primary Examiner* — Binh Q Tran

(74) *Attorney, Agent, or Firm* — Geoffrey Brumbaugh; McCoy Russell LLP

(57) ABSTRACT

Methods and systems are provided for a mixer. In one example, a system may include a mixer arranged in a passage and configured to mix two dissimilar types of gases upstream of a device.

14 Claims, 7 Drawing Sheets

(56) References Cited

U.S. PATENT DOCUMENTS

| | | | |
|---|---|---|---|
| 2016/0215673 | A1 | 7/2016 | Noren, IV et al. |
| 2016/0326938 | A1 | 11/2016 | Zhang |
| 2017/0120193 | A1 | 5/2017 | Zhang |

* cited by examiner

EXHAUST GAS MIXER

FIELD

The present description relates generally to an exhaust gas mixer.

BACKGROUND/SUMMARY

Higher combustion and exhaust temperatures may be exhibited during higher engine loads and/or boosted engine conditions. These higher temperatures may increase nitrogen oxide ($NO_x$) emissions and cause accelerated degradation of catalytic materials in the engine and exhaust system. Exhaust gas recirculation (EGR) is an approach to combat these effects. EGR strategies reduce an oxygen content of intake air by diluting it with exhaust. When the diluted air/exhaust mixture is used in place of ambient air not mixed with exhaust gas to support combustion in the engine, lower combustion and exhaust temperatures are exhibited. EGR also increases fuel economy in gasoline engines by reducing throttling losses and heat rejections.

Alternatively, when engine conditions are not suitable for EGR, one technology for after-treatment of engine exhaust utilizes selective catalytic reduction (SCR) to enable certain chemical reactions to occur between $NO_x$ in the exhaust and ammonia ($NH_3$). $NH_3$ is introduced into an engine exhaust system upstream of an SCR catalyst by injecting reductant into an exhaust pathway. The reductant entropically decomposes to $NH_3$ under high temperature conditions. The SCR facilitates the reaction between $NH_3$ and $NO_x$ to convert $NO_x$ into nitrogen ($N_2$) and water ($H_2O$). However, issues may arise upon injecting reductant into the exhaust pathway. In one example, reductant may be poorly mixed into the exhaust flow (e.g., a first portion of exhaust flow has a higher concentration of urea than a second portion of exhaust flow) which may lead to poor coating of the SCR and poor reactivity between emissions (e.g., $NO_x$) and the SCR.

Thus, exhaust gas mixing, whether with intake air, reductant, or on its own, is vital to achieve optimal engine performance. Attempts to address insufficient exhaust gas mixing include arranging flow mixers along a passage to increase turbulence of gas flowing therethrough.

However, the inventors herein have recognized potential issues with such systems. As one example, these mixers are often complex in design and difficult to incorporate in differently shaped engine systems. For example, the mixers may not accommodate various bends and/or injectors present in a passage. Additionally, molds and/or casts of these mixers are expensive, resulting in increased manufacturing costs.

In one example, the issues described above may be addressed by an engine system comprising a mixing plate arranged between a first passage, a second passage, and an auxiliary passage, each of which is coupled to a chamber, and where the plate is perforated and comprises an S-shaped cross-section separating the chamber into two portions, where the first passage is coupled to a first portion and the second passage is coupled to a second portion. In this way, gas in the first portion (and in one example all of the gas) is forced to flow through the plate before entering the second portion.

As one example, the auxiliary passage is coupled to the first portion. Gases from the first passage and the auxiliary passage may collide in the first portion before flowing through perforations of the plate to the second portion. The plate may increase turbulence which may promote mixing between the gases from the first passage and the auxiliary passage. The mixture may flow through pieces of the second portion before flowing into the second passage. In this way, the mixture may provide increased efficiency and performance in components arranged in the second passage downstream of the plate and chamber.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

FIGS. 2A-6 are shown approximately to scale

DETAILED DESCRIPTION

Figure 1:
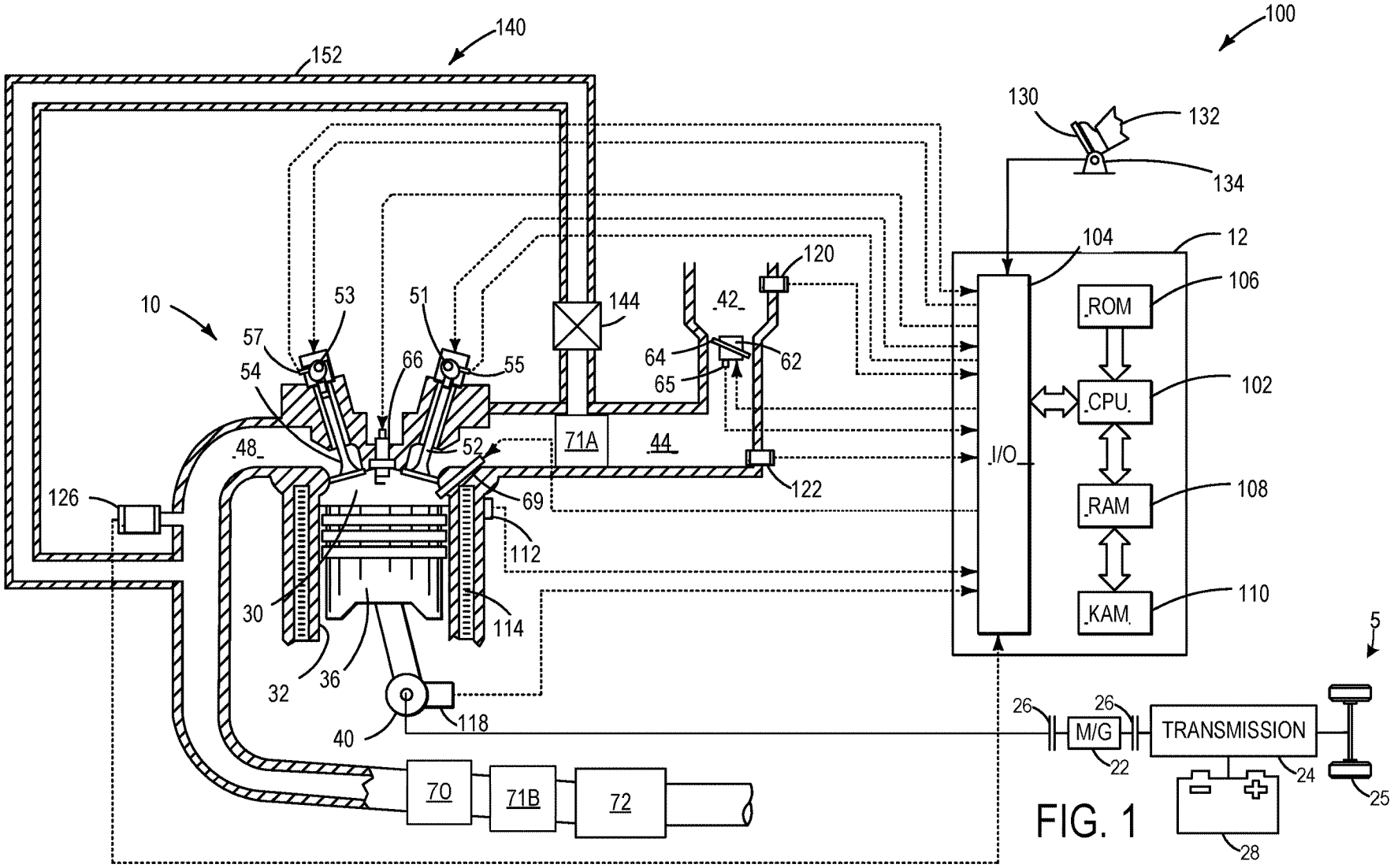
FIG. 1 shows a schematic of a single cylinder of an engine including an exhaust gas mixer.

The following description relates to an exhaust gas mixer. The exhaust gas mixer may be arranged in an engine intake system and configured to mix exhaust gas recirculation (EGR) with intake gas. Additionally or alternatively, the exhaust gas mixer may be arranged in an engine exhaust system and configured to mix exhaust gas with a reductant injection. An engine is shown in FIG. 1 comprising at least one cylinder fluidly coupled to an intake system and exhaust system. Both systems optionally including a mixer arranged therein.

Figure 2B:
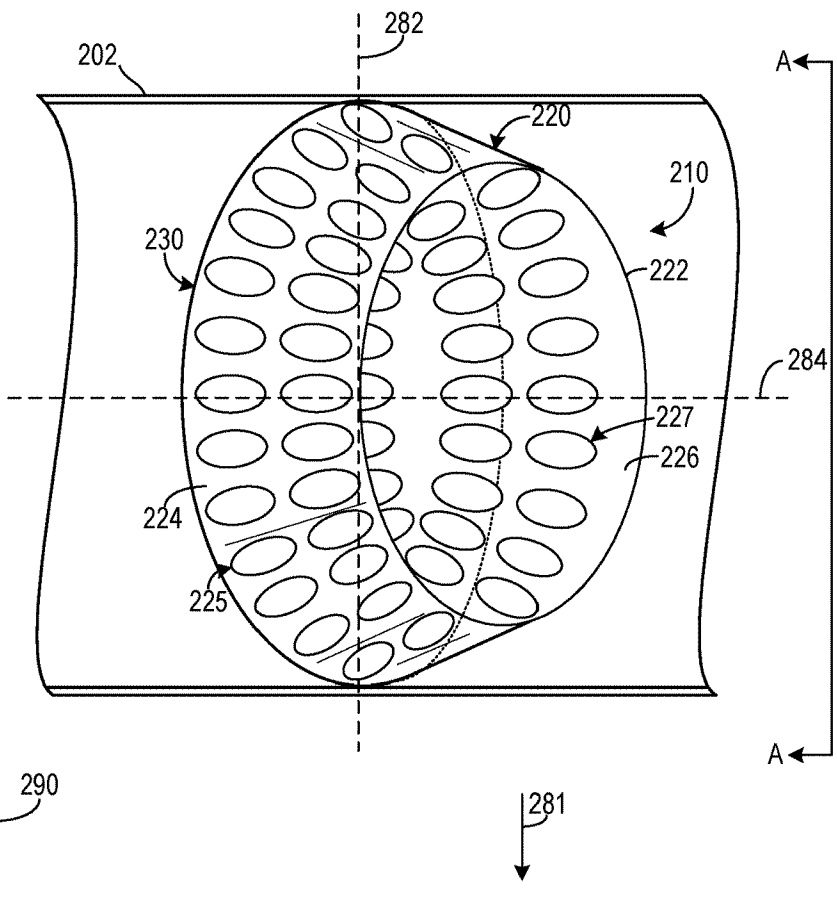
FIGS. 2A and 2B show perspective views of a first example of an exhaust gas mixer.
Figure 2A:
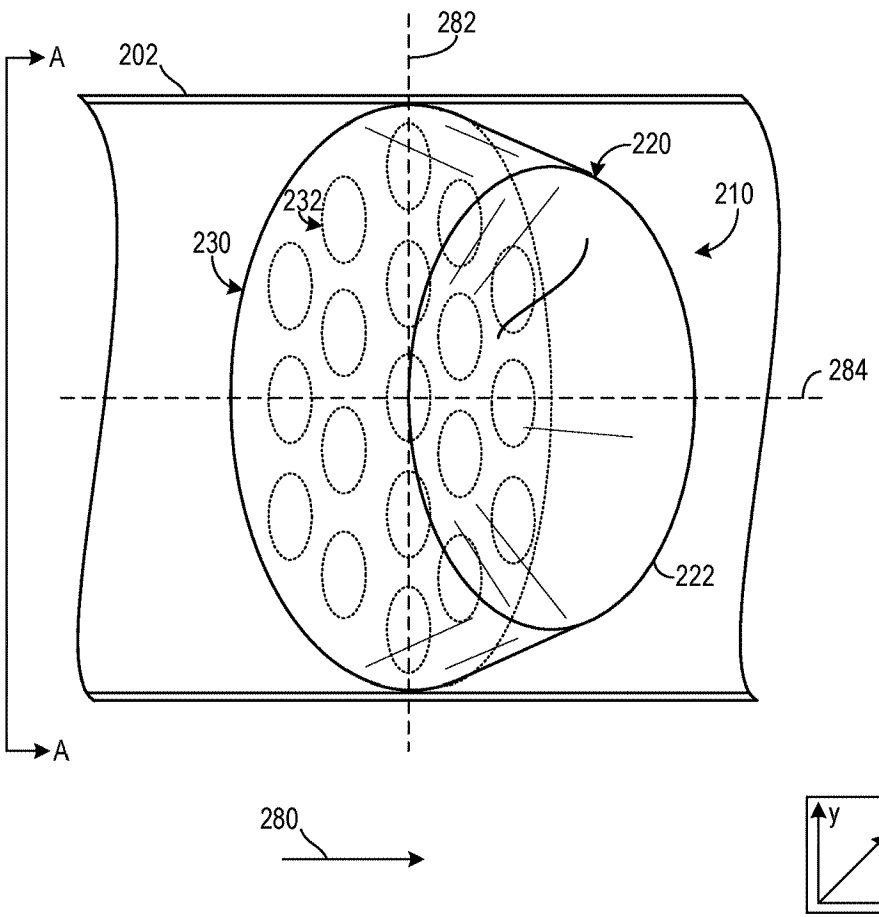
Figure 3:
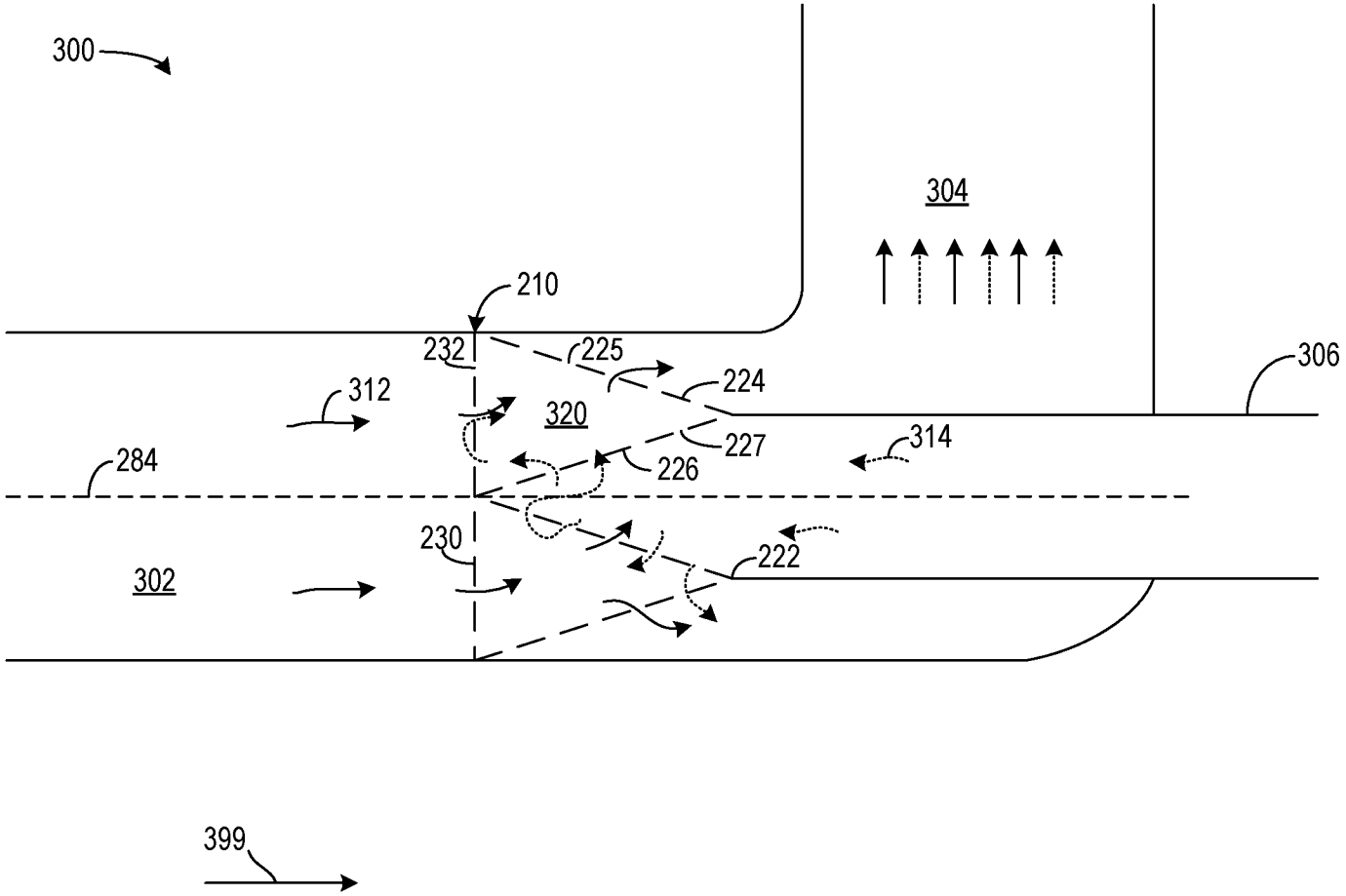
FIG. 3 shows a cross-sectional view of the first example of the exhaust gas mixer with an example exhaust gas flow therethrough.

In one example, the mixers arranged in the intake and exhaust systems are substantially identical. However, the mixers may be differently shaped to accommodate different intake and exhaust system geometries. A first example of the mixer is shown in FIGS. 2A and 2B. The mixer includes a circular plate physically coupled to a protrusion. An example of first and second gases flowing through the mixer is shown in FIG. 3.

Figure 4:
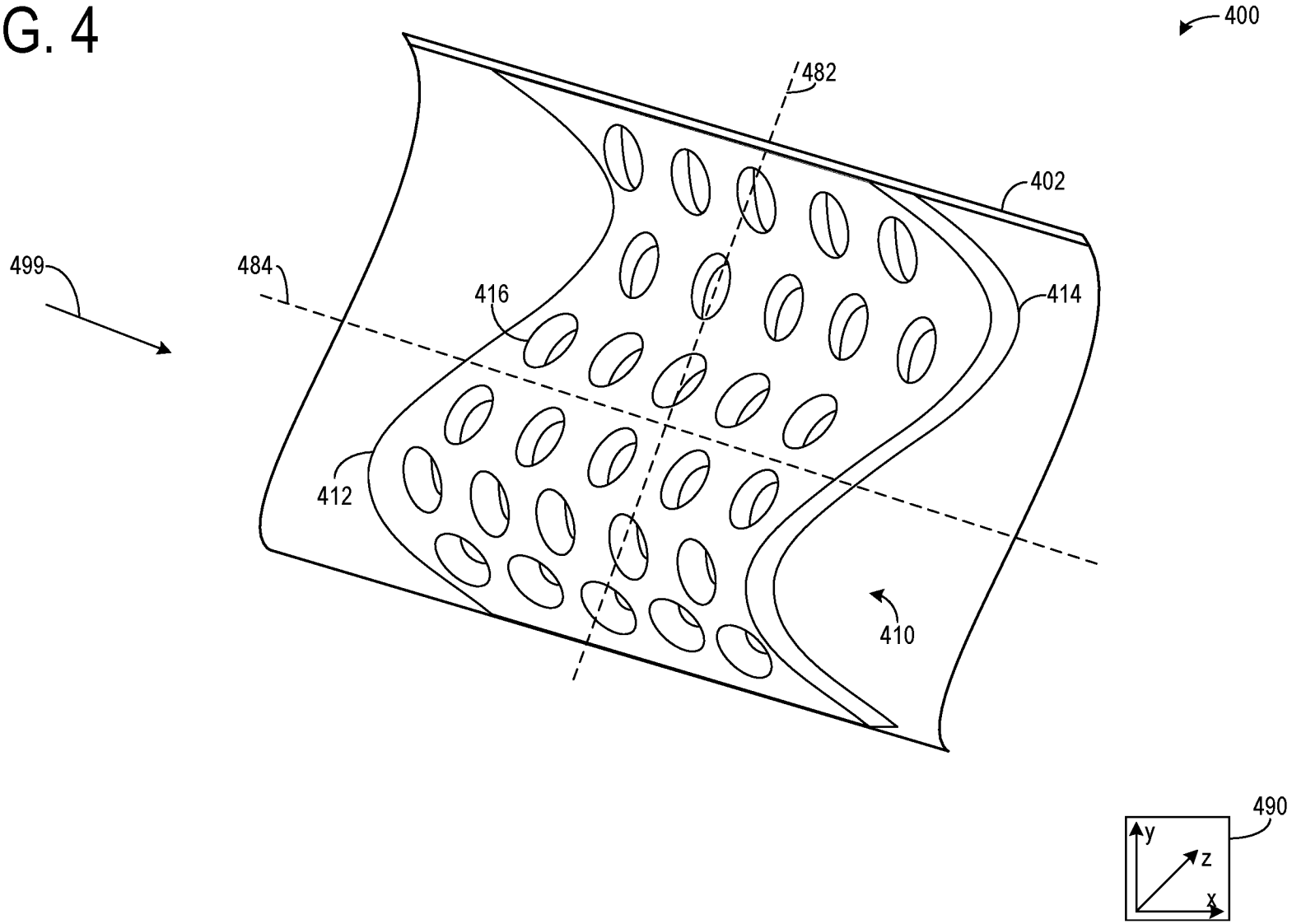
FIG. 4 shows a perspective view of a second example of an exhaust gas mixer.

A second example of the mixer is shown in FIG. 4. It shows a mixer arranged in a chamber coupled to a first passage, a second passage, and an auxiliary passage. The mixer may divide the chamber into separate portions, where a first portion is coupled to the first passage and the auxiliary passage and the second portion is coupled to the second passage. The mixer is curved and perforated. This may enable the mixer to direct gases from the first portion to the second portion in a plurality of radial directions.

Figure 5B:
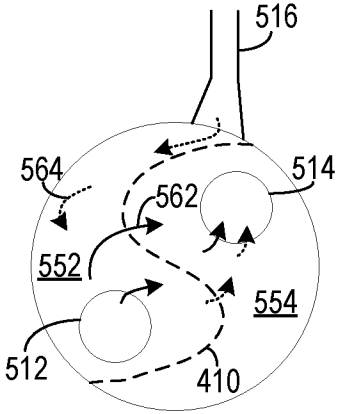
FIG. 5B shows a cross-sectional view of the chamber with the second example of the exhaust gas mixer.
Figure 5A:
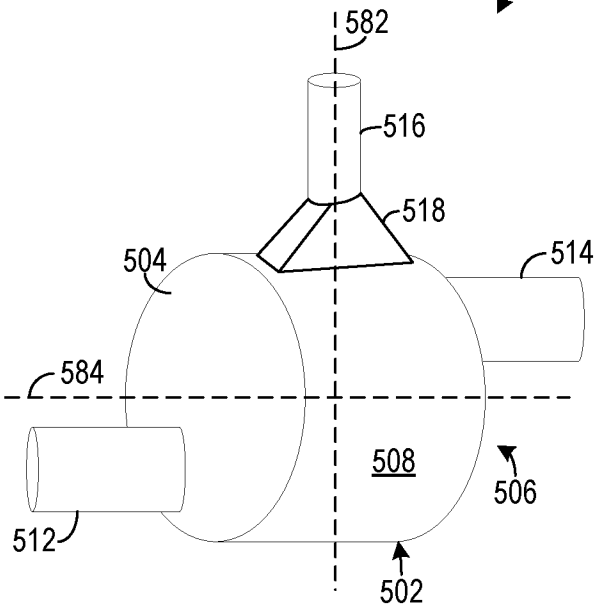
FIG. 5A shows a chamber where the second example of the exhaust gas mixer is arranged.

An example of the first passage, second passage, and auxiliary passage coupled to the chamber is shown in FIG. 5A. An upstream-to-downstream view of an interior of the chamber including the mixer is shown in FIG. 5B. Example gas flows through the mixer and the chamber are shown in both FIGS. 5B and 6.

Different locations of the mixers in relation to various components in the engine intake system and/or exhaust system are shown in FIGS. 7A-7D.

FIGS. 1-7D show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example. It will be appreciated that one or more components referred to as being "substantially similar and/or identical" differ from one another according to manufacturing tolerances (e.g., within 1-5% deviation).

Figure 6:
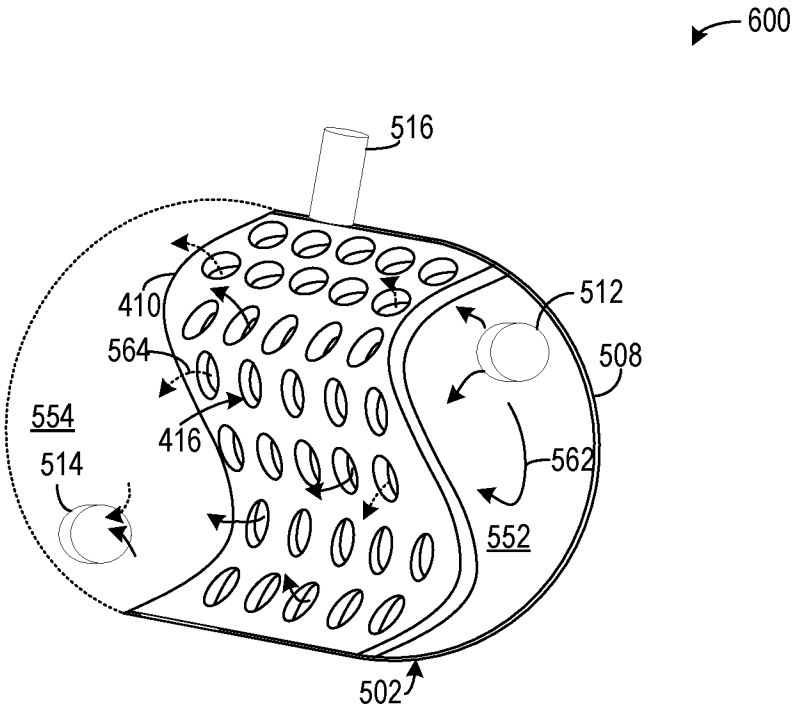
FIG. 6 shows a perspective view with an outer portion of the chamber being omitted with an example exhaust gas flow therethrough.

Note that FIGS. 3, 5B, and 6 show arrows indicating where there is space for gas to flow, and the solid lines of the device walls show where flow is blocked and communication is not possible due to the lack of fluidic communication created by the device walls spanning from one point to another. The walls create separation between regions, except for openings in the wall which allow for the described fluid communication.

Continuing to FIG. 1, a schematic diagram showing one cylinder of a multi-cylinder engine 10 in an engine system 100, which may be included in a propulsion system of an automobile, is shown. The engine 10 may be controlled at least partially by a control system including a controller 12 and by input from a vehicle operator 132 via an input device 130. In this example, the input device 130 includes an accelerator pedal and a pedal position sensor 134 for generating a proportional pedal position signal. A combustion chamber 30 of the engine 10 may include a cylinder formed by cylinder walls 32 with a piston 36 positioned therein. The piston 36 may be coupled to a crankshaft 40 so that reciprocating motion of the piston is translated into rotational motion of the crankshaft. The crankshaft 40 may be coupled to at least one drive wheel of a vehicle 5 via an intermediate transmission system. Further, a starter motor may be coupled to the crankshaft 40 via a flywheel to enable a starting operation of the engine 10.

The combustion chamber 30 may receive intake air from an intake manifold 44 via an intake passage 42 and may exhaust combustion gases via an exhaust passage 48. The intake manifold 44 and the exhaust passage 48 can selectively communicate with the combustion chamber 30 via respective intake valve 52 and exhaust valve 54. In some examples, the combustion chamber 30 may include two or more intake valves and/or two or more exhaust valves.

In this example, the intake valve 52 and exhaust valve 54 may be controlled by cam actuation via respective cam actuation systems 51 and 53. The cam actuation systems 51 and 53 may each include one or more cams and may utilize one or more of cam profile switching (CPS), variable cam timing (VCT), variable valve timing (VVT), and/or variable valve lift (VVL) systems that may be operated by the controller 12 to vary valve operation. The position of the intake valve 52 and exhaust valve 54 may be determined by position sensors 55 and 57, respectively. In alternative examples, the intake valve 52 and/or exhaust valve 54 may be controlled by electric valve actuation. For example, the cylinder 30 may alternatively include an intake valve controlled via electric valve actuation and an exhaust valve controlled via cam actuation including CPS and/or VCT systems.

A fuel injector 69 is shown coupled directly to combustion chamber 30 for injecting fuel directly therein in proportion to the pulse width of a signal received from the controller 12. In this manner, the fuel injector 69 provides what is known as direct injection of fuel into the combustion chamber 30. The fuel injector 69 may be mounted in the side of the combustion chamber or in the top of the combustion chamber, for example. Fuel may be delivered to the fuel injector 69 by a fuel system (not shown) including a fuel tank, a fuel pump, and a fuel rail. In some examples, the combustion chamber 30 may alternatively or additionally include a fuel injector arranged in the intake manifold 44 in a configuration that provides what is known as port injection of fuel into the intake port upstream of the combustion chamber 30.

Spark is provided to combustion chamber 30 via spark plug 66. The ignition system may further comprise an ignition coil (not shown) for increasing voltage supplied to spark plug 66. In other examples, such as a diesel, spark plug 66 may be omitted.

The intake passage 42 may include a throttle 62 having a throttle plate 64. In this particular example, the position of throttle plate 64 may be varied by the controller 12 via a signal provided to an electric motor or actuator included with the throttle 62, a configuration that is commonly referred to as electronic throttle control (ETC). In this manner, the throttle 62 may be operated to vary the intake air provided to the combustion chamber 30 among other engine cylinders. The position of the throttle plate 64 may be provided to the controller 12 by a throttle position signal. The intake passage 42 may include a mass air flow sensor 120 and a manifold air pressure sensor 122 for sensing an amount of air entering engine 10.

An exhaust gas sensor 126 is shown coupled to the exhaust passage 48 upstream of an emission control device 70 according to a direction of exhaust flow. The sensor 126 may be any suitable sensor for providing an indication of exhaust gas air-fuel ratio such as a linear oxygen sensor or UEGO (universal or wide-range exhaust gas oxygen), a two-state oxygen sensor or EGO, a HEGO (heated EGO), NOR, HC, or CO sensor. In one example, upstream exhaust gas sensor 126 is a UEGO configured to provide output, such as a voltage signal, that is proportional to the amount of oxygen present in the exhaust. Controller 12 converts oxygen sensor output into exhaust gas air-fuel ratio via an oxygen sensor transfer function.

The emission control device 70 is shown arranged along the exhaust passage 48 downstream of the exhaust gas sensor 126. The device 70 may be a three-way catalyst (TWC), particulate filter, diesel oxidation catalyst, $NO_x$ trap, various other emission control devices, or combinations thereof. In some examples, during operation of the engine 10, the emission control device 70 may be periodically reset by operating at least one cylinder of the engine within a particular air-fuel ratio.

A selective catalytic reduction (SCR) device 72 is shown arranged along the exhaust passage 48 downstream of the emission control device 70. In some examples, the emission control device 70 may be omitted and only the SCR device 72 may be located downstream of the exhaust gas sensor 126. In other examples, the SCR device 72 may be upstream of the emission control device 70. An injector (not shown) may be arranged upstream of the SCR device 72. The injector may be positioned to inject a reductant into the exhaust passage 48. A reservoir may store the reductant. The reductant may comprise fuel, urea, or the like. The controller 12 may signal to an actuator.

An exhaust gas recirculation (EGR) system 140 may route a desired portion of exhaust gas from a portion of the exhaust passage 48 upstream of the emission control device 70 to the intake manifold 44 via an EGR passage 152. The amount of EGR provided to the intake manifold 44 may be varied by the controller 12 via an EGR valve 144. Under some conditions, the EGR system 140 may be used to regulate the temperature of the air-fuel mixture within the combustion chamber, thus providing a method of controlling the timing of ignition during some combustion modes.

A first mixer 71A is arranged at an intersection between the intake manifold 44 and the EGR passage 152 downstream of throttle 62. The first mixer 71A may be configured to increase mixing between exhaust gas and intake gas upstream of the cylinder 30. A second mixer 71B is arranged between the emission control device 70 and the SCR device 72. The second mixer 71B may be configured to mix exhaust gas from various portions of the exhaust passage (e.g., outer radial portions may mix with inner radial portions). In one example, the first mixer 71A and the second mixer 71B are identical. Additionally or alternatively, the first mixer 71A and the second mixer 71B are different mixers. It will be appreciated that the positions of the first 71A and second 71B mixers are examples and other positions have been contemplated herein, as shown in FIGS. 7A-7D below.

The first and second mixers 71A, 71B may comprise a chemically inert material such that reactions do not occur between constituents in a gas flow and surfaces of the mixers. Additionally or alternatively, the first and second mixers 71A, 71B may be comprise of one or more of carbon fiber, magnesium, aluminum, steel, titanium, plastic, alloys, and the like. The first and second mixers 71A, 71B may further comprise a coating configured to provide the mixers with a non-stick surface. The coating may comprise one or more of ceramics, silica, Teflon, and the like. The first and second mixers 71A, 71B may be arranged in linear or bent portions of a passage without departing from the scope of the present disclosure.

The controller 12 is shown in FIG. 1 as a microcomputer, including a microprocessor unit 102, input/output ports 104, an electronic storage medium for executable programs and calibration values shown as read only memory chip 106 (e.g., non-transitory memory) in this particular example, random access memory 108, keep alive memory 110, and a data bus. The controller 12 may receive various signals from sensors coupled to the engine 10, in addition to those signals previously discussed, including measurement of inducted mass air flow (MAF) from the mass air flow sensor 120; engine coolant temperature (ECT) from a temperature sensor 112 coupled to a cooling sleeve 114; an engine position signal from a Hall effect sensor 118 (or other type) sensing a position of crankshaft 40; throttle position from a throttle position sensor 65; and manifold absolute pressure (MAP) signal from the sensor 122. An engine speed signal may be generated by the controller 12 from crankshaft position sensor 118. Manifold pressure signal also provides an indication of vacuum, or pressure, in the intake manifold 44. Note that various combinations of the above sensors may be used, such as a MAF sensor without a MAP sensor, or vice versa. During engine operation, engine torque may be inferred from the output of MAP sensor 122 and engine speed. Further, this sensor, along with the detected engine speed, may be a basis for estimating charge (including air) inducted into the cylinder. In one example, the crankshaft position sensor 118, which is also used as an engine speed sensor, may produce a predetermined number of equally spaced pulses every revolution of the crankshaft.

The storage medium read-only memory 106 can be programmed with computer readable data representing non-transitory instructions executable by the processor 102 for performing the methods described below as well as other variants that are anticipated but not specifically listed. The controller 12 receives signals from the various sensors of FIG. 1 and employs the various actuators of FIG. 1 to adjust engine operation based on the received signals and instructions stored on a memory of the controller.

In some examples, vehicle 5 may be a hybrid vehicle with multiple sources of torque available to one or more vehicle wheels 25. In other examples, vehicle 5 is a conventional vehicle with only an engine, or an electric vehicle with only electric machine(s). In the example shown, vehicle 5 includes engine 10 and an electric machine 22. Electric machine 22 may be a motor or a motor/generator. Crankshaft 40 of engine 10 and electric machine 22 are connected via a transmission 24 to vehicle wheels 25 when one or more clutches 26 are engaged. In the depicted example, a first clutch 26 is provided between crankshaft 40 and electric machine 22, and a second clutch 26 is provided between electric machine 22 and transmission 24. Controller 12 may send a signal to an actuator of each clutch 26 to engage or disengage the clutch, so as to connect or disconnect crankshaft 40 from electric machine 22 and the components connected thereto, and/or connect or disconnect electric machine 22 from transmission 24 and the components connected thereto. Transmission 24 may be a gearbox, a planetary gear system, or another type of transmission. The powertrain may be configured in various manners including as a parallel, a series, or a series-parallel hybrid vehicle.

Electric machine 22 receives electrical power from a traction battery 28 to provide torque to vehicle wheels 25. Electric machine 22 may also be operated as a generator to provide electrical power to charge battery 28, for example during a braking operation.

Turning now to FIGS. 2A-2B, they show the same perspective view of a mixer 210. However, in FIG. 2A, protrusion 220 is transparent to allow visualization of plate 230. Thus, in FIG. 2B, the protrusion 220 is not transparent and the plate 230 is occluded by the protrusion. FIGS. 2A-2B are described in tandem herein.

An axis system 290 including three axes, namely an x-axis parallel to a horizontal direction (arrow 280), a y-axis parallel to a vertical direction, and a z-axis perpendicular to both the x- and y-axes. A direction of gas flow is substantially parallel to arrow 280. Herein, arrow 280 may be interchangeably referred to as the direction of gas flow 280 or horizontal direction 280. Gravity is shown by arrow 281 (herein, gravity 281).

The mixer 210 may be arranged in a passage 202. The passage 202 may be tubular. In one example, the mixer 210 is physically coupled along the outer circumference of plate 230 to interior surfaces of the passage 202. Coupling elements between the mixer 210 and interior surfaces of the passage 202 may include one or more of welds, screws, fusions, adhesives, and the like. Gas may not flow between the interior surfaces of the passage 202 and the outer circumference of the mixer 210. Thus, the plate 230 comprises a diameter corresponding to a diameter of the passage 202 such that gas in the passage 202 is forced to flow through the plate 230 before reaching its intended destination. The mixer 210 may be used similarly to one or more of the first mixer 71A and the second mixer 71B of FIG. 1. As such, the passage 202 may be similar to intake passage 42 and/or intake manifold 44 of FIG. 1 or exhaust passage 48. Thus, gas flow 280 may refer to exhaust gas flow or intake gas flow dependent on the location of the mixer 210.

The mixer 210 is fixedly coupled to the passage 202 such that it is immovable. Thus, the mixer 210 does not slide, rotate, or actuate. Additionally, the mixer 210 is not mechanically, hydraulically, pneumatically, or electrically powered.

In one example, if the passage 202 is an intake passage and the mixer 210 is an EGR mixer, then the arrow 280 depicts a direction of intake gas flow. The mixer may receive exhaust gas recirculate (EGR) flow at a direction transverse or exactly opposite to the direction of intake gas flow.

The mixer 210, including the protrusion 220 and the plate 230, may resemble a bowl with a flat bottom (e.g., such as a dog bowl). Additionally or alternatively, the mixer 210 may resemble a toroid and/or donut cut in half lengthwise with beveled edges and omitting an opening along its center. The mixer 210 is symmetric about the central axis 284.

The plate 230 may be substantially parallel to a y-z plane. Thus, the plate 230 is substantially planar. Surfaces of the plate 230 may be impervious to gas flow. Gas colliding with surfaces of the plate 230 may ricochet therefrom and do not flow therethrough. The plate 230 comprises a plurality of perforations 232 arranged on its surface configured to allow gas to traverse the plate 230. The perforations 232 may be symmetrically arranged on the plate 230 about the vertical axis 282 and/or the central axis 284. However, it will be appreciated that the perforations 232 may be asymmetrically arranged on the plate 230 without departing from the scope of the present disclosure. In this way, the perforations 232 are the only portion of the plate 230 through which gas may flow. Said another way, gas flowing in the passage 202 from an upstream to downstream direction relative to the plate 230 may only reach portions of the passage 202 downstream of the plate 230 by flowing through one or more perforations 232 of the plate 230. Thus, the plate 230 may be a uniform, contiguous plate having perforations arranged thereon.

Each perforation of the perforations 232 is elliptical and similar in size, in one example. However, it will be appreciated that each perforation of the perforations 232 may be differently shaped than elliptical and from one another. For example, one or more perforations of the perforations 232 may be triangular, square, rectangular, circular, pentagonal, hexagonal, and the like without departing from the scope of the present disclosure.

The plate 230 may be physically coupled to a protrusion 220 along its outer circumference. Said another way, a portion of the plate 230 which is coupled to interior surface of the passage 202 may also be coupled to the protrusion 220. The coupling between the plate 230 and the protrusion 220 may include one or more of welds, fusions, adhesives, screws, and the like.

An apex 222 of the protrusion 220 corresponds to a portion of the protrusion 220 furthest away from the plate 230. An outer surface 224 of the protrusion 220 extends from the outer circumference of the plate 230 toward the apex 222. As shown, the outer surface 224 is oblique to the surface of the plate 230. In one example, an angle generated between the plate 230 and the outer surface 224 is between 60-80°. Additionally, an inner surface 226 of the protrusion 220 extends from a center of the plate 230 toward the apex 222. The inner surface 226 may be angled similarly to the outer surface 224 relative to the plate 220. The inner surface 226 and the outer surface 224 intersect and physically couple at the apex 222.

A cross-section of the outer surface 224 taken along a y-z plane may be substantially circular. The cross-section of the outer surface 224 may decrease in diameter along the x-axis from the plate 230 to the apex 222. Likewise, a cross-section of the inner surface 226 taken along the y-z plane may be substantially circular. The cross-section of the inner surface 226 may increase in diameter along the x-axis from the plate 230 to the apex 222. In this way, the cross-sections of both the outer 224 and inner 226 surfaces approach one another until they are identical at the apex 222.

The outer surface 224 further comprises outer perforations 225. Likewise, the inner surface 226 comprises inner perforations 227. The outer 225 and inner 227 perforations may be substantially identical. Alternatively, the outer 225 and inner 227 perforations may be different. Shapes of the outer 225 and inner 227 perforations may include one or more triangular, circular, elliptical, square, rectangular, pentagonal, or the like. The surfaces of the protrusion 220 are impervious to gas flow. Thus, the outer 225 and inner 227 perforations may permit gas to traverse the protrusion 220. A space may be located between each of the plate 230, outer surface 224, and inner surface 226 for exhaust gas to enter and flow through. The perforations 232, outer perforations 225, and inner perforations 227 may fluidly couple the space to the passage 202.

Turning now to FIG. 3, it shows an embodiment 300 of a cross-section of the mixer 210 according to cutting plane A-A. Thus, components previously presented may be similarly numbered in subsequent figures. An example gas flow through the mixer 210 is illustrated. Solid line arrows 312 may represent a first gas and dashed line arrows may represent a second gas different from the first. As shown, the cross-section of the mixer 210 taken along the x-axis comprises a triangular shape, with equally sized triangles arranged on both sides of the central axis 284.

In the embodiment 300, the mixer 210 may be depicted as an EGR mixer arranged in an intake passage (e.g., intake passage 42 of FIG. 1) with an inlet passage 302 and an outlet passage 304. The outlet passage 304 is downstream of the mixer 210 relative to a general direction of intake air flow in the inlet passage 302 (arrow 399). The outlet passage 304 is perpendicular to the inlet passage 302 and EGR passage 306 (e.g., EGR passage 152 of FIG. 1). The apex 222 of the mixer 210 is shown physically coupled to the EGR passage 306 such that EGR may be directly flowed to the inner surface 226. Thus, solid line arrows 312 depict multiple exemplary intake air flows through the mixer 210. Dashed lines 314 depict multiple exemplary EGR flows through the mixer 210.

It will be appreciated that in some embodiments, the orientations of the outlet passage 304 and the EGR passage 306 may be reversed without departing from the scope of the present disclosure. That is to say, the EGR passage 306 may be perpendicular to the inlet passage 302 and the outlet passage 304 may be parallel to the inlet passage 302. The outlet passage 304 may be physically coupled to the apex 222 of the mixer 210, similar to the EGR passage 306 of the embodiment 300. As such, a diameter of the outlet passage 304 may be less than a diameter of the inlet passage in such an example.

In an additional embodiment, the mixer 210 may be arranged in an exhaust gas passage. A reductant injector may be positioned in the exhaust passage to inject reductant toward or adjacent to the mixer. The injector may be positioned at a variety of angles relative to the central axis of the mixer. In this way, the mixer 210 may be further configured to mix only exhaust gas or exhaust gas with reductant. In such an example, the passage 306 may correspond to a passage for introducing reductant into the exhaust passage. Passages 302 and 304 may represent upstream and downstream portions, respectively, of the exhaust passage separated by the mixer 210.

The inlet passage 302 may direct intake gas 312 toward the plate 230 of the mixer 210. The diameter of the plate 230 corresponds to the diameter of the inlet passage 302. Thus, intake air flow 312 may flow through the mixer 210 before flowing to the outlet passage 304. In the example of FIG. 3, all the intake gas 312 in the inlet passage 302 flows through the mixer 210 before flowing to the outlet passage 304. As illustrated, the intake gas 312 flows through perforations 232 and enters a space 320 of the mixer 210. While in the space 320, the intake gas 312 may flow in a plurality of directions. These directions may include radially outward toward interior surfaces of the passage 302, radially inward toward the central axis, and/or longitudinally along the central axis 284. The intake gas 312 may flow through the outer perforations 225 of the outer surface 224, flow through the inner perforations 227 of the inner surface 226, or flow through a combination thereof. In one example, the intake gas 312 is forced to flow through at least the perforations 232 of the plate and outer perforations 225 of the outer surface 224 before reaching the outlet passage 304. By doing this, turbulence imparted onto the intake gas 312 increases, thereby increasing a misdirection and unpredictability of the intake gas 312 direction of flow.

Specifically, the outer perforations 225 may direct the first gas 312 to flow toward the interior surfaces of the inlet passage 302. By contrast, the inner perforations 227 may direct the first gas 312 to flow toward the central axis 284. This perturbation may result in an increased number of collisions between gases from radial different portions of the inlet passage 302 before the gas reaches the outlet passage 304.

The EGR passage 306 may direct EGR toward the apex 222 and/or inner surface 226 of the mixer 210. The diameter of the EGR passage 306 may correspond to a diameter of the apex 222 such that EGR flow may flow through the mixer 210 before flowing to the outlet passage 304. In the example of FIG. 3, all the EGR 314 flows through the mixer 210 before flowing to the outlet passage 304. As illustrated, EGR 314 flows through inner perforations 227 of the inner surface 226 and enters the space 320. While in the space 320, the EGR 314 may flow in a plurality of directions. The EGR 314 may flow through the outer perforations 225, through the perforations 232 of the plate 230, or a combination thereof. Additionally or alternatively, the EGR 314 may collide with intake gas 312 once it leaves the EGR passage 306. This may occur in the space 320 or in other portions of the inlet passage 302 and/or mixer 210 upstream of the outlet passage 304. In this way, a homogeneity of intake gas and EGR increases relative to an intake passage that does not comprise the mixer 210. By increase EGR mixing with intake gas, EGR distribution among each cylinder of the cylinders of an engine may be more even, providing great combustion stability, emissions reduction, and fuel economy.

Specifically, before EGR 314 flows into the outlet passage 304, it flows through the inner perforations 227, through the outer perforations 225, and into the outlet passage 304. Thus, any gas (e.g., intake gas 312 or EGR 314) is forced to flow through the outer perforations 225 prior to flowing to the outlet passage 304. By forcing the gases to flow through the mixer 210 prior to reaching the outlet passage 304, mixing may be increased.

Turning now to FIG. 4, it shows an embodiment 400 of a mixer 410 arranged in a passage 402. The mixer 410 may be used similarly to the first mixer 71A or the second mixer 71B of FIG. 1. Thus, the mixer 410 may be configured to mix intake gas with EGR or increase a homogeneity of exhaust gas with or without reductant. The axis system 490 is substantially similar to the axis system 290 included in FIGS. 2A-2B.

The mixer 410 may be physically coupled to interior surfaces of the passage 402 via one or more of welds, fusions, screws, adhesives, and the like. The mixer 410 is fixedly coupled to the passage 402. In one example, the mixer 410 does not slide, rotate, oscillate, or conduct any other forms of movement. As such, the mixer 410 is stationary and immovable.

The mixer 410 may be is curved about the vertical 482 and central 484 axes of the mixer 410. In one example, the curvature of the mixer 410 is substantially S-shaped. It will be appreciated that a period of the curvature of the mixer 410 may be truncated such that multiple undulations of the mixer are formed. For example, in the embodiment 400 of FIG. 4, a single period of the curvature of the mixer is shown, with two apices 412 and 414 pointing in opposite directions. As such, multiple iterations of the two apices 412 and 414 may be included in other embodiments of the mixer without departing from the scope of the present disclosure. For example, there may be a total of four, six, eight, 10, etc. of the apices 412 and 414. In one example, a number of apices is even such that the number of apices 412 is equal to a number of apices 414. In other examples, a total number of apices may be odd such that the number of apices 412 is unequal to the number of apices 414.

Portions of the passage 402 may be divided and/or separated by the mixer 410. Gas between the two portions may mix after flowing through one or more apertures 416. The apertures 416 extend through an entire surface of the mixer 410 and may be the only portion of the mixer 410 through which gas may flow. The mixer 410 may divide the passage 402 into unequal portions with a first portion being larger than the second portion. In this way, the mixer 410 may be shorter than a diameter of the passage 402 while still being physically coupled to interior surfaces of the passage 402. In one example, a height of the mixer 410 is equal to a diameter of the passage 402 such that the passage 402 is divided into halves.

Each aperture of the apertures 416 is substantially identical in size and shape. The apertures 416 may be circular, elliptical, triangular, rectangular, pentagonal, trapezoidal, square-shaped, diamond-shaped, and the like. The apertures 416 may be misaligned about the vertical axis 482. Additionally or alternatively, the apertures 416 may be aligned about the vertical axis 482 with a space between each of the apertures being substantially uniform. The apertures 416 may be transverse relative to a general direction of gas flow (arrow 499). In one example, the apertures 416 are perpendicular to the direction of gas flow. The apertures 416 follow a curvature of the mixer 410 such that an orientation of apertures 416 on adjacent rows is different. However, an orientation of apertures 416 on a shared row is substantially similar. A row may include a series of adjacent apertures parallel to the direction of gas flow. Thus, apertures in a row share a similar vertical height. In this way, apertures arranged at different heights are not in the same row.

In some examples, the shape and size of apertures 416 may differ between rows. For example, apertures on a first row may be different from apertures on a second row.

Turning now to FIG. 5A, it shows an embodiment 500 of a chamber 502 housing a mixer (e.g., mixer 410 of FIG. 4). The chamber 502 may be used similarly to the passage 402 of FIG. 4. The chamber 502 may be cylindrical, as shown, however other suitable shapes have been contemplated herein. For example, the chamber 502 may be a cube, a rectangular prism, a sphere, and other three-dimensional shapes.

A first passage 512 is fluidly coupled to an upstream end 504 of the chamber 502. A second passage 514 is fluidly coupled to a downstream end 506 of the chamber 502. The upstream 504 and downstream 506 ends of the chamber 502 are arranged on opposite sides of a tubular wall 508 of the chamber 502. The upstream end 504 and downstream end 506 are physically coupled to the tubular wall 508 via welds, fusions, screws, adhesives, or the like. The upstream end 504, downstream end 506, and tubular wall 508 are impervious to exhaust gas flow. Thus, the chamber 502 comprises no other inlets or additional outlets other than the first passage 512 and the second passage 514. In this way, gas may not flow directly through the upstream end 504, downstream end 506, or tubular wall 508 to an ambient atmosphere or engine.

A diameter of the chamber 502 is greater than diameters of the first passage 512 and the second passage 514. The first passage 512 and the second passage 514 may be radially misaligned with one another relative to the central axis 584. Additionally, the first passage 512 and the second passage 514 may be vertically misaligned with one another. In the example shown, the first passage 512 is lower than the second passage 514.

An auxiliary passage 516 may be coupled to the chamber 502 at a higher region of the chamber 502 relative to positions of the first passage 512 and the second passage 514. An adapter 518 may be arranged between the auxiliary passage 516 and the tubular wall 508. The adapter 518 may be configured to diffuse and/or scatter a flow of gas from the auxiliary passage 516 into the chamber 502. The auxiliary passage 516 may be biased toward one side of the chamber 502, as shown in FIG. 5B.

Turning now to FIG. 5B, it shows an embodiment 550 of an interior of the chamber 502. Specifically, it shows an upstream-to-downstream view of the chamber 502 with the upstream 504 and downstream 506 ends being omitted. The interior of the chamber 502 houses the mixer 410. The mixer 410 divides the interior of the chamber 502 into first 552 and second 554 portions. Due to the vertical and radial misalignment of the first 512 and second 514 passages, the first portion 552 is directly fluidly coupled to the first passage 512 and the auxiliary passage 516. The second portion 554 is directly fluidly coupled to the second passage 514. The auxiliary passage 516 is positioned to direct gases initially along a curvature of the mixer 410 before either flowing through the mixer 410 to the second portion 554 or flowing through a remainder of the first portion 552. The auxiliary passage 516 may direct gas into the chamber 502 in a direction transverse to the direction of gas flow from the first passage 512 to the chamber 502. In one example, the direction of gas leaving the auxiliary passage 516 and entering the chamber 502 is perpendicular to the direction of gas leaving the first passage 512 and entering the chamber 502.

Solid line arrows 562 represent a first gas flow and dashed line arrows 564 represent a second gas flow. In one example, the solid line arrows 562 represent intake gas and the dashed line arrows 564 represent EGR. In another example, the solid line arrows 562 represent exhaust gas and the dashed line arrows 564 represent a gaseous reductant. It will be appreciated that dashed line arrows 564 may represent liquid reductant without departing from the scope of the present disclosure. Thus, the auxiliary passage 516 may be fluidly coupled to an EGR passage or a reductant injector outlet. As shown, arrows 562 and 564 may flow through a volume of the first portion 552 of the chamber 502 before flowing through apertures (e.g., apertures 416) of the mixer 410 and into the second portion 554. The second passage 514 may receive the first gas flow 562 and the second gas flow 564 from the second portion 554. An additional example of gas flow through a chamber comprising the mixer 410 is shown in FIG. 6.

Turning now to FIG. 6, it shows an embodiment 600 omitting a surface of the second portion 554 to illustrate gas flow through the mixer, from the first portion 552 to the second portion 554. A first gas (solid line arrows 562) flows from the first passage 512 and into the first portion 552. As such, the first passage 512 may be function as an inlet passage. The first gas may flow throughout a volume of the first portion 552 arranged between the mixer 410 and a corresponding surface of the tubular wall 508. The first portion 552 may further receive a second gas (dashed line arrows 564), which may also flow throughout a volume of the first portion 552. The first gas and the second gas may mix within the first portion 552 before flowing into the second portion 554. Additionally or alternatively, the first and second gases may flow through the mixer 410 to the second portion 554 without mixing in the first portion 552.

The apertures 416 of the mixer 410 may impart disparate directionalities to the first and second gas flows based on a location through which the first and second gas flows flow through the mixer 410. This may be due to the curvature of the mixer 410. Said another way, apertures 416 of different rows may direct the first and second gases in different angular directions. The apertures 416, may direct the first and second gas flows in radially different directions toward a surface of the tubular wall 508 corresponding to the second portion 554. As a result, turbulence may be increased which may further promote mixing before the first and second gases flow out of the second portion 554 of the chamber 502 and into the second passage 514.

Turning now to FIGS. 7A-7D, they shows various embodiments of intake and exhaust systems comprising a mixer. The mixers illustrated in the FIGS. 7A-7D may be substantially identical to first mixer 71A and/or second mixer 71B of FIG. 1 or mixer 210 of FIGS. 2A-2B or mixer 410 of FIG. 4.

Figure 7A:
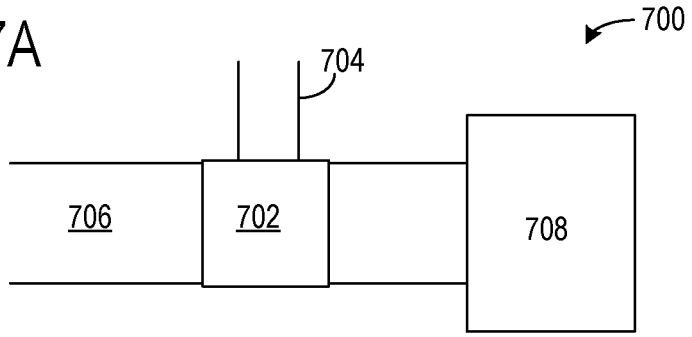
FIGS. 7A, 7B, 7C, and 7D show various locations of an exhaust gas mixer in intake or exhaust systems.

Turning now to FIG. 7A, it shows an embodiment 700 illustrating a mixer 702 arranged at a junction between an EGR outlet 704 and an intake passage 706 upstream of an engine 708. The mixer may mix exhaust gas with intake gas upstream of the engine 708. It will be appreciated that the mixer 702 may be arranged downstream of the junction and upstream of the engine 708 without departing from the scope of the present disclosure.

Figure 7B:
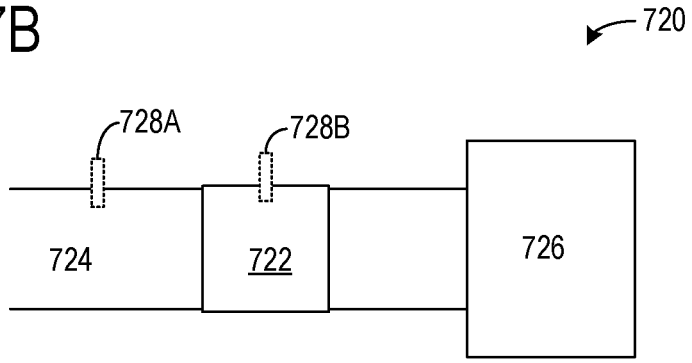

Turning now to FIG. 7B, it shows an embodiment 720 illustrating a mixer 722 arranged in an exhaust passage 724 comprising an aftertreatment device 726 arranged downstream of the mixer 722. In one example, the aftertreatment device 726 is an SCR device. The exhaust passage 724 may further comprise a reductant injector arranged at a first position, shown by reductant injector 728A. Alternatively, the exhaust passage 724 may comprise a reductant injector arranged at a second position, shown by reductant injector 728B. Reductant injector 728A is positioned to inject reductant into a portion of the exhaust passage 724 upstream of the mixer 722. Conversely, reductant injector 728B is positioned to inject reductant into a portion of the exhaust passage 724 corresponding to a location of the mixer 722. The reductant injected may be liquid or gas. At any rate, the mixer 722 may be configured to increase mixing between injected reductant and exhaust gas. By increasing reductant dispersion and homogeneity in the exhaust gas flowing to the SCR device 726, reductant may interact with a greater surface area of the SCR device 726. This may increase SCR device 726 performance.

Figure 7C:
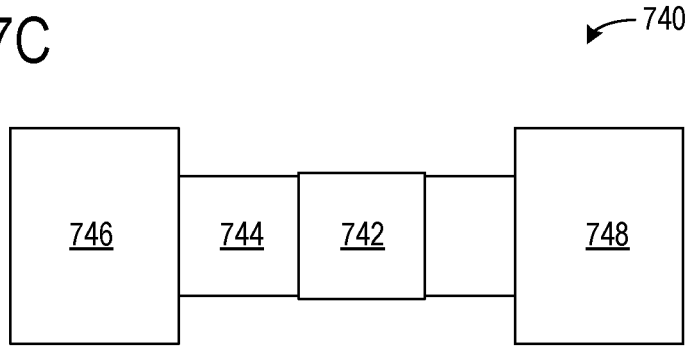

Turning now to FIG. 7C, it shows an embodiment 740 of a mixer 742 arranged in an exhaust passage 744. The mixer 742 is arranged between a first catalyst 746 and a second catalyst 748. In one example, the first catalyst 746 is an oxidation catalyst and the second catalyst 748 is a lean $NO_x$ trap. The first catalyst 746 and the second catalyst 748 may be other types and/or combinations of catalysts without departing from the scope of the present disclosure.

Figure 7D:
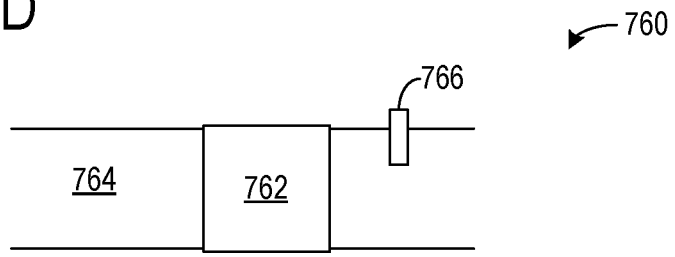

Turning now to FIG. 7D, it shows an embodiment 760 of a mixer 762 arranged in an exhaust passage 764 upstream of an exhaust gas sensor 766. The exhaust gas sensor 766 may be used similarly to exhaust gas sensor 126 of FIG. 1. By arranging the mixer 762 upstream of the exhaust gas sensor 766, a reliability of feedback provided from the sensor 766 may increase, which may result in improved engine operating conditions. For example, a more accurate air/fuel ratio may be sensed by the sensor 766, which may result in improved fuel economy and/or power output.

In this way, a compact, easy to manufacture mixer may be located upstream of a variety of exhaust system components to increase an accuracy of a sensor reading or improve efficacy of exhaust after-treatment devices. Additionally or alternatively, the mixer may be arranged at a junction between an EGR passage and an intake passage to improve EGR distribution to each cylinder of an engine. Additionally, by manufacturing each component to be physically coupled, a sturdiness of the mixer is increased such that as exhaust passes over the mixer, the mixer do not vibrate and/or rattle. In this way, the mixer may be quieter that other mixers comprising longer components or cascading stages. The technical effect of placing a mixer in a passage is to improve a mixture homogeneity such that components downstream of the mixer may increase functionality.

An embodiment of a system comprising a mixing plate arranged between a first passage, a second passage, and an auxiliary passage, each of which is coupled to a chamber, and where the plate is perforated and comprises an S-shaped cross-section separating the chamber into two portions, where the first passage is coupled to a first portion and the second passage is coupled to a second portion. A first example of the system further includes where the cross-section of the plate is undulating. A second example of the system, optionally including the first example, further includes where the perforations fluidly couple the first portion to the second portion, and where gas from the first passage flows through the perforations before flowing to the second passage. A third example of the system, optionally including the first and/or second examples further includes where the chamber comprises upstream and downstream ends physically coupled to opposite ends of a tubular wall, and where the first passage is coupled to the upstream end, the second passage is coupled to the downstream end, and the auxiliary passage is coupled to the tubular wall. A fourth example of the system, optionally including one or more of the first through third examples, further includes where the auxiliary passage is coupled to a portion of the tubular wall corresponding to the first portion. A fifth example of the system, optionally including one or more of the first through fourth examples, further includes where the auxiliary passage is an exhaust gas recirculation passage. A sixth example of the system, optionally including one or more of the first through fifth examples, further includes where the auxiliary passage is fluidly coupled to an outlet of a reductant injector. A seventh example of the system, optionally including one or more of the first through sixth examples, further includes where the first and second passages are radially misaligned with one another relative to a center of the chamber. An eighth example of the system, optionally including one or more of the first through seventh examples, further includes where the chamber and the plate are symmetric about a central axis of the mixer.

An embodiment of an exhaust gas mixer comprises a perforated circular plate physically coupled to a perforated protrusion having two circular cross-sections merging at an apex, an auxiliary passage physically coupled to the apex of the protrusion adjacent a bend between first and second passages, where the first passage directs a first gas in a first direction, and where the auxiliary passage directs a second gas in a second direction opposite the first direction. A first example of the exhaust gas mixer further includes where the circular cross-sections are taken along a plane of the mixer perpendicular to the first and second directions, and where cross-sections of the plate and the protrusion taken parallel to the first and second directions is triangle shaped. A second example of the exhaust gas mixer, optionally including the first example, further includes where the first passage is separated from both the second passage and the auxiliary passage by the plate and the protrusion. A third example of the exhaust gas mixer, optionally including the first and/or second examples, further includes where the plate is fixedly coupled to interior surfaces of the first passage. A fourth example of the exhaust gas mixer, optionally including one or more of the first through third examples further includes where the plate and the protrusion form a space located therebetween, wherein the space is configured to receive gases from the first passage and the auxiliary passage. A fifth example of the exhaust gas mixer, optionally including one or more of the first through fourth examples, further includes where the protrusion further comprises a perforated outer surface and a perforated inner surface, and where the first gas from the first passage flows through at least perforations of the plate and the outer surface before reaching the second passage, and where the second gas from the second passage flows through at least perforations of the inner and outer surfaces before reaching the second passage.

An embodiment of an engine system comprises an inlet passage misaligned with an outlet passage, further comprising an auxiliary passage angled to both the inlet and outlet passages and an exhaust gas mixer arranged adjacent to an intersection of each of inlet passage, outlet passage, and auxiliary passage, the mixer comprising perforated surfaces separating the passages to force gas from the inlet passage and auxiliary to flow through the mixer before flowing to the outlet passage. A first example of the engine system further includes where the auxiliary passage is oriented opposite to the inlet passage and perpendicular to the outlet passage, and where the mixer comprises a circular, perforated plate comprising a diameter equal to a diameter of the inlet passage, further comprising a bowl-shaped, perforated protrusion fixedly coupled to the plate and to the auxiliary passage. A second example of the engine system, optionally including the first example, further includes where the inlet passage is vertically lower than both the outlet passage and the auxiliary passage for a vehicle with its wheels on the ground, and where the mixer separates the inlet and auxiliary passages from the outlet passage. A third example of the engine system, optionally including the first and/or second examples, further includes where the mixer is immovable, and where there are no other inlets or additional outlets other than the inlet passage, auxiliary passage, and outlet passage. A fourth example of the engine system, optionally including one or more of the first through third examples, further includes where the mixer is housed in a chamber and divides the chamber into halves, wherein a first half of the chamber is directly coupled to the inlet passage and auxiliary passage, and where a second half of the chamber is directly coupled to the outlet passage.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. An engine system comprising:

a mixing plate arranged between a first passage, a second passage, and an auxiliary passage, each of which is coupled to a chamber having a central axis in a direction of exhaust flow, and where the plate is perforated and comprises an S-shaped cross-section separating the chamber into two portions, where the first passage is coupled to a first portion and the second passage is coupled to a second portion, a leading side apex of the plate faces exhaust flow and a trailing side apex of the plate is opposite the leading side apex, and the first passage leads to the chamber parallel to, but offset from, the central axis and the second passage exits the chamber parallel to, but offset from, the central axis.

2. The engine system of claim 1, wherein the cross-section of the plate is undulating.

3. The engine system of claim 1, wherein the perforations fluidly couple only the first portion to the second portion, and where gas from the first passage flows into the first portion, through the perforations, and into the second portion before flowing to the second passage.

4. The engine system of claim 1, wherein the chamber comprises upstream and downstream ends physically coupled to opposite ends of a tubular wall, and where the first passage is coupled to the upstream end, the second passage is coupled to the downstream end, and the auxiliary passage is coupled to the tubular wall.

5. The engine system of claim 4, wherein the auxiliary passage is coupled to a portion of the tubular wall corresponding to the first portion.

6. The engine system of claim 4, wherein the auxiliary passage is an exhaust gas recirculation passage.

7. The engine system of claim 4, wherein the auxiliary passage is fluidly coupled to an outlet of an injector.

8. The engine system of claim 1, wherein the first and second passages are radially misaligned with one another relative to a center of the chamber.

9. The engine system of claim 1, wherein the chamber and the plate are symmetric about a central axis of the mixing plate.

10. An engine system comprising:

an inlet passage misaligned with and parallel to an outlet passage, the inlet and outlet passages aligned with a central axis in an exhaust flow direction;

an auxiliary passage angled to both the inlet and outlet passages; and an exhaust gas mixer arranged adjacent to an intersection of each of the inlet passage, the outlet passage, and the auxiliary passage, the mixer comprising perforated surfaces separating the passages to force gas from the inlet passage and the auxiliary passage to flow through the mixer before flowing to the outlet passage, a perforated plate having a leading side apex of the plate facing exhaust flow and a trailing side apex of the plate opposite the leading side apex.

11. The engine system of claim 10, wherein the auxiliary passage is oriented opposite to the inlet passage and perpendicular to the outlet passage, and where the mixer comprises the perforated plate.

12. The engine system of claim 10, wherein the inlet passage is vertically lower than both the outlet passage and the auxiliary passage for a vehicle with its wheels on the ground, and where the mixer separates the inlet and auxiliary passages from the outlet passage.

13. The engine system of claim 10, wherein the mixer is immovable, and where there are no other inlets or additional outlets other than the inlet passage, the auxiliary passage, and the outlet passage.

14. The engine system of claim 10, wherein the mixer is housed in a chamber and divides the chamber into halves, wherein a first half of the chamber is directly coupled to the inlet passage and the auxiliary passage, and where a second half of the chamber is directly coupled to the outlet passage.

* * * * *